US006340019B1

(12) United States Patent
Eshleman et al.

(10) Patent No.: US 6,340,019 B1
(45) Date of Patent: Jan. 22, 2002

(54) FUEL RAIL MOUNTING BRACKET WITH ISOLATOR

(75) Inventors: Edgar Samuel Eshleman, Bloomfield; Gary John Deangelis, Spencerport, both of NY (US)

(73) Assignee: Delphi Technologies, Inc., Troy, MI (US)

( * ) Notice: Subject to any disclaimer, the term of this patent is extended or adjusted under 35 U.S.C. 154(b) by 0 days.

(21) Appl. No.: 09/659,174

(22) Filed: Sep. 11, 2000

(51) Int. Cl.[7] ..... F02M 37/04
(52) U.S. Cl. ..... 123/469
(58) Field of Search ..... 123/456, 468, 123/469; 248/49

(56) References Cited

U.S. PATENT DOCUMENTS 5,044,338 A * 9/1991 Shelton ..... 123/469
5,172,671 A * 12/1992 Peters et al. ..... 123/456
5,682,857 A * 11/1997 Briggs et al. ..... 123/456

* cited by examiner

*Primary Examiner*—Thomas N. Moulis
(74) *Attorney, Agent, or Firm*—John VanOphem

(57) ABSTRACT

An isolator design provides for the isolation of each fuel rail mounting bracket from the intake manifold mounting boss and the screw assembly secures the fuel rail assembly to the intake manifold. The isolator assembly reduces the amount of heat transfer from the hot engine intake manifold to the fuel rail assembly, which in turn transfers heat back to the fuel tank via the fuel return line. The isolation of the fuel rail assembly to the intake manifold is accomplished by an isolator washer placed between the fuel rail mounting bracket and the manifold mounting boss. An isolator sleeve has locking tabs, which snap onto an inside diameter rib on the isolator washer. The mounting screw passes through the isolator washer and isolator sleeve to thereby securely lock each element of the isolator design. The assembly provides a structure for attachment of both isolator parts to the fuel rail mounting bracket. This assembly secures the isolators to the rail assembly during handling until installation of the rail on the manifold is completed. The locking tabs also provide isolation of the screw assembly with respect to the mounting bracket.

20 Claims, 4 Drawing Sheets

FUEL RAIL MOUNTING BRACKET WITH ISOLATOR

FIELD OF THE INVENTION

The present invention relates to an isolator design that provides a simple method to incorporate an isolator to a fabricated fuel rail design. Specifically, the invention is a snap-on rail mounting isolator that reduces heat transfer from a metallic intake manifold to a metal-fabricated fuel rail.

DESCRIPTION OF RELATED ART

Fuel rails for supplying gasoline fuel to an internal combustion engine are well known in the art. These fuel rails generally provide a conduit from which fuel is distributed to a plurality of individual fuel injectors (i.e. "multi-point" fuel injection).

In the most common arrangement, fuel is pumped from a fuel reservoir, through a fuel supply line, to the fuel rail. Fuel flows through the fuel rail to a plurality of fuel injectors. The fuel rail is attached to the top of the fuel injectors, and supplies fuel into the upper end of each fuel injector, which then injects the fuel into the intake manifold of the engine. Normally, not all of the fuel passing through the rail is fed to the injectors. The remaining fuel passes through the fuel rail to a fuel return line. Typically, a fuel pressure regulator is employed in the fuel return line downstream of the last injector. Fuel not used by the injectors is then returned to the reservoir via the return line.

Vehicle performance problems are a major concern in fuel rail designs. Vehicle barrier issues may negate the use of plastic fuel rails as well as plastic mounting brackets. Moreover, press-fitting an isolator onto a metal fuel rail requires more tooling and increases the number of maintenance issues to be addressed. Increased parts increases the probability of loose parts falling into the manifold and eventually into the engine block, potentially damaging the engine.

The need exists for a fuel rail design that does not suffer from the heat transfer problems inherent in the conventional designs and that does not increase the manufacturing, tooling and maintenance problems inherent in the conventional designs.

SUMMARY OF THE INVENTION

The present invention provides a simple method to incorporate an isolator to a metal fabricated fuel rail design with a minimal snap-on fit attachment load.

With the present invention, the number of loose parts during the fuel rail to intake manifold assembly process is reduced. Moreover, if vehicle barrier issues are of a concern, which may negate the use of a plastic fuel rail and a heat sink prone metal fabricated fuel rail is required, vehicle performance problems resulting from hot fuel handling may be addressed by incorporating the plastic isolators.

Alternatives to the use of the plastic isolators would be the use of a plastic fuel rail design or incorporating plastic mounting brackets to a metal fuel rail. However, vehicle barrier requirements and fuel rail packaging requirements on the intake manifold, may dictate a metal fuel rail design.

The structural arrangement of the present invention provides a fuel rail design that is more cost effective, that will meet stringent packaging and performance requirements, and that may be more conducive to efficient manufacturing initiatives. Barrier concerns can be addressed with use of metal fabricated fuel rails where protection of the fuel system is reduced. Packaging issues can be addressed where the intake manifold requires an unconventional fuel rail design, which may dictate a metal fuel rail process that does not permit a cost effective process such as plastic to be used, yet hot fuel handling may be a concern. Press fitting an isolator onto a metal fuel rail design requires more tooling and maintenance issues to be addressed. A manual, light force snap-fit installed isolator, as proposed by this invention, can make the overall manufacturing process more efficient and effective by improving handling at the assembly plant.

The plastic snap-on rail mounting isolator of this invention reduces the heat transfer from a metallic intake manifold to a metal fabricated rail. This heat transferral would potentially cause hot fuel handling vehicle driveability problems as well as heat the excess unused fuel from the fuel rail being returned back to the fuel tank. In turn, this can cause vehicle emission problems. The snap-on feature prevents loose parts from falling into the manifold and eventually into the engine block, potentially damaging the engine.

The provision of a simple snap-on plastic isolator with minimal assembly force effectively reduces the heat transfer of the engine to the fuel in the fuel rail assembly, hence reducing vehicle hot fuel handling and emission problems. This invention also affords greater design flexibility in offering customers more cost effective rail designs for their packaging constraints.

DETAILED DESCRIPTION OF THE PREFERRED EMBODIMENT

Figure 1:
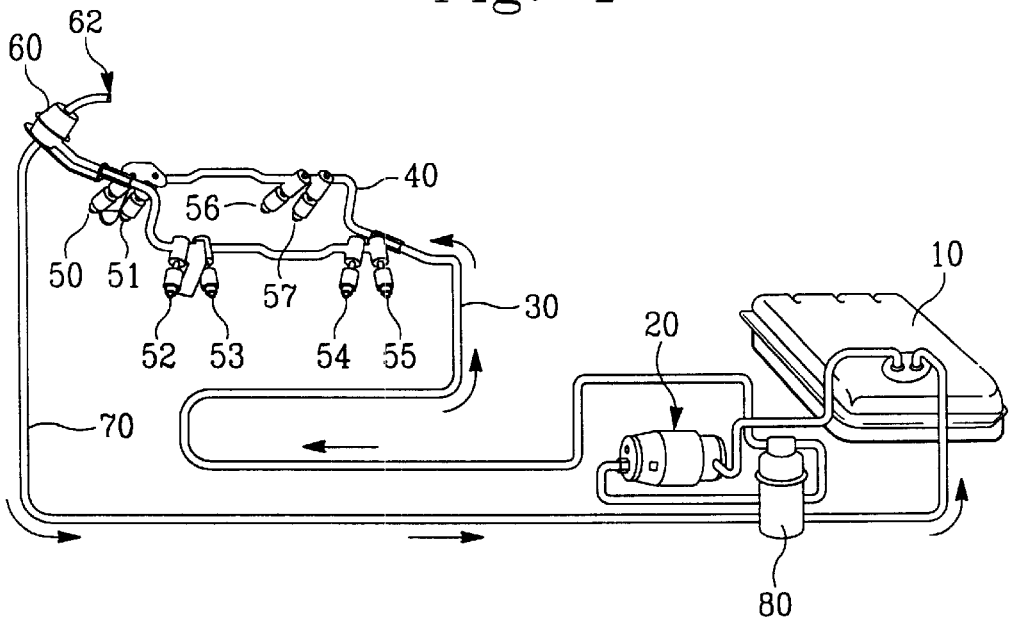
FIG. 1 is a schematic illustration of an electronic multi-point fuel injection system and showing a fuel rail assembly.

With reference to FIG. 1, an electronic multi-point fuel injection system is schematically shown including the fuel tank 10, fuel pump 20, fuel feed line 30, fuel rail 40, injector valves 50–57, pressure regulator 60, fuel return line 70, and fuel filter 80. Such an electronic multi-point fuel injector system typically uses a computer, engine sensors and one solenoid injector for each engine cylinder. The operation of the electronic multi-point injector system is similar to a modulated, single point injection system; however, fuel is injected at each intake port instead of at the top center of the intake manifold.

A multi-point pressure regulator 60 is mounted in the fuel line before or after the injectors and in FIG. 1 the regulator 60 is shown after the injectors. A vacuum line 62 leads from the regulator 60 to the engine intake manifold (not shown). The regulator 60 maintains a constant pressure at the inlet to the injector valves 50–57 by acting as a bypass branch.

Figure 2A:
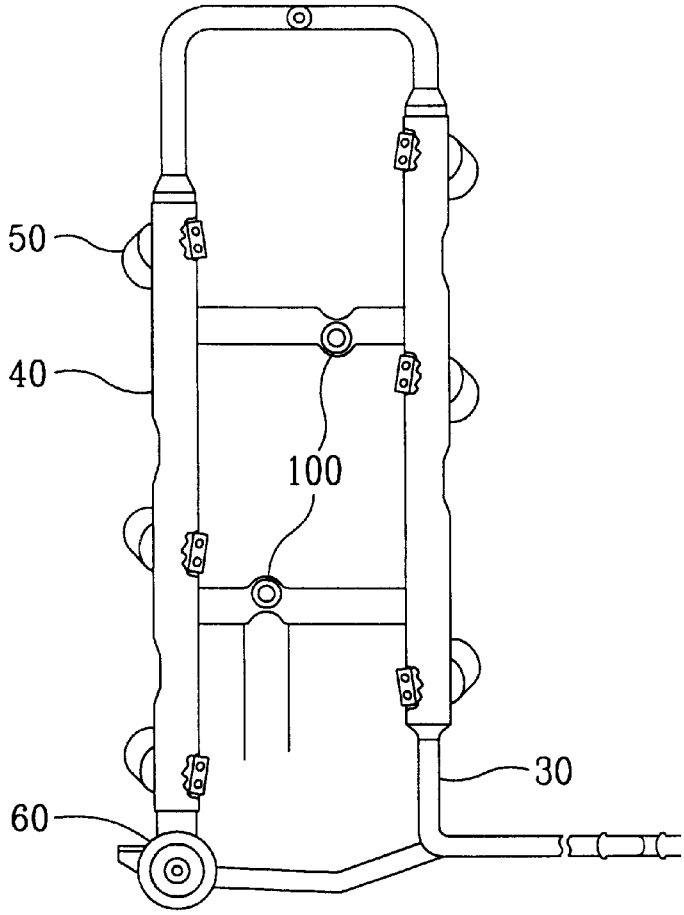
FIG. 2*a* is a top view of an exemplary fuel rail showing two locations of the isolators of this invention.
Figure 2B:
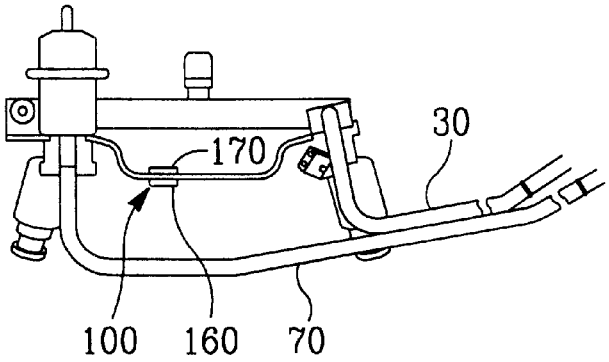
FIG. 2*b* is an end view of the fuel rail assembly of FIG. 2*a;*

The fuel rail 40 feeds fuel to each injector 50–57, and it primarily consists of a tubing assembly that connects the main fuel line to the inlet of each injector 50–57. One fuel rail design is shown in FIGS. 2*a* and 2*b*, where FIG. 2*a* is a top view of a fuel rail layout and FIG. 2*b* is an end view of the fuel rail design of FIG. 2*a*. As seen in FIGS. 2*a* and 2*b*, the fuel rail 40 receives fuel from the fuel feed line 30. In FIG. 2*a*, six injectors are shown.

Figure 3:
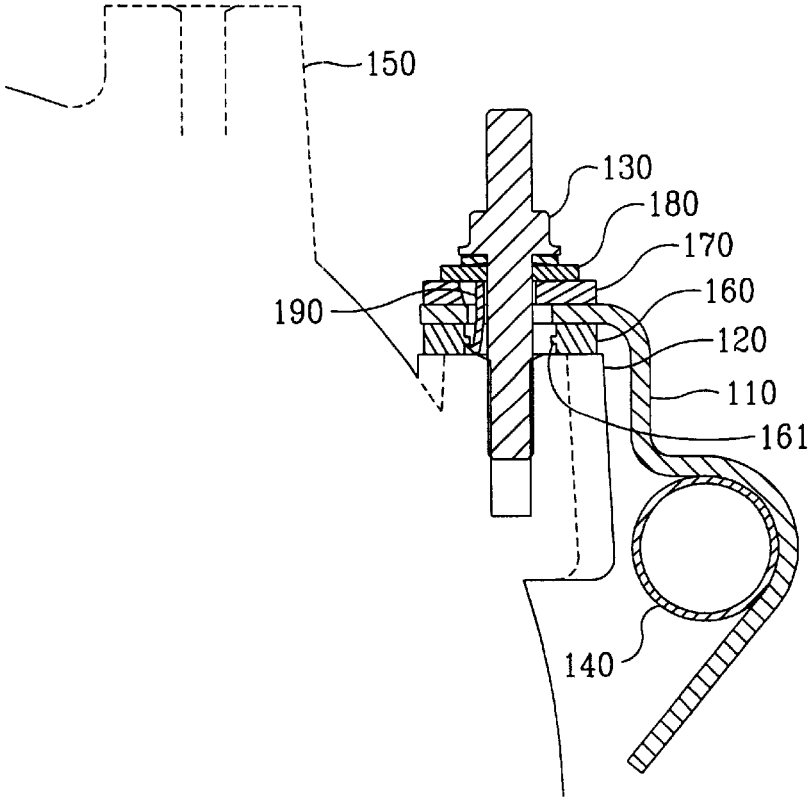
FIG. 3 is a cross sectional view of an isolator assembly according to this invention mounted to an intake manifold.
Figure 4:
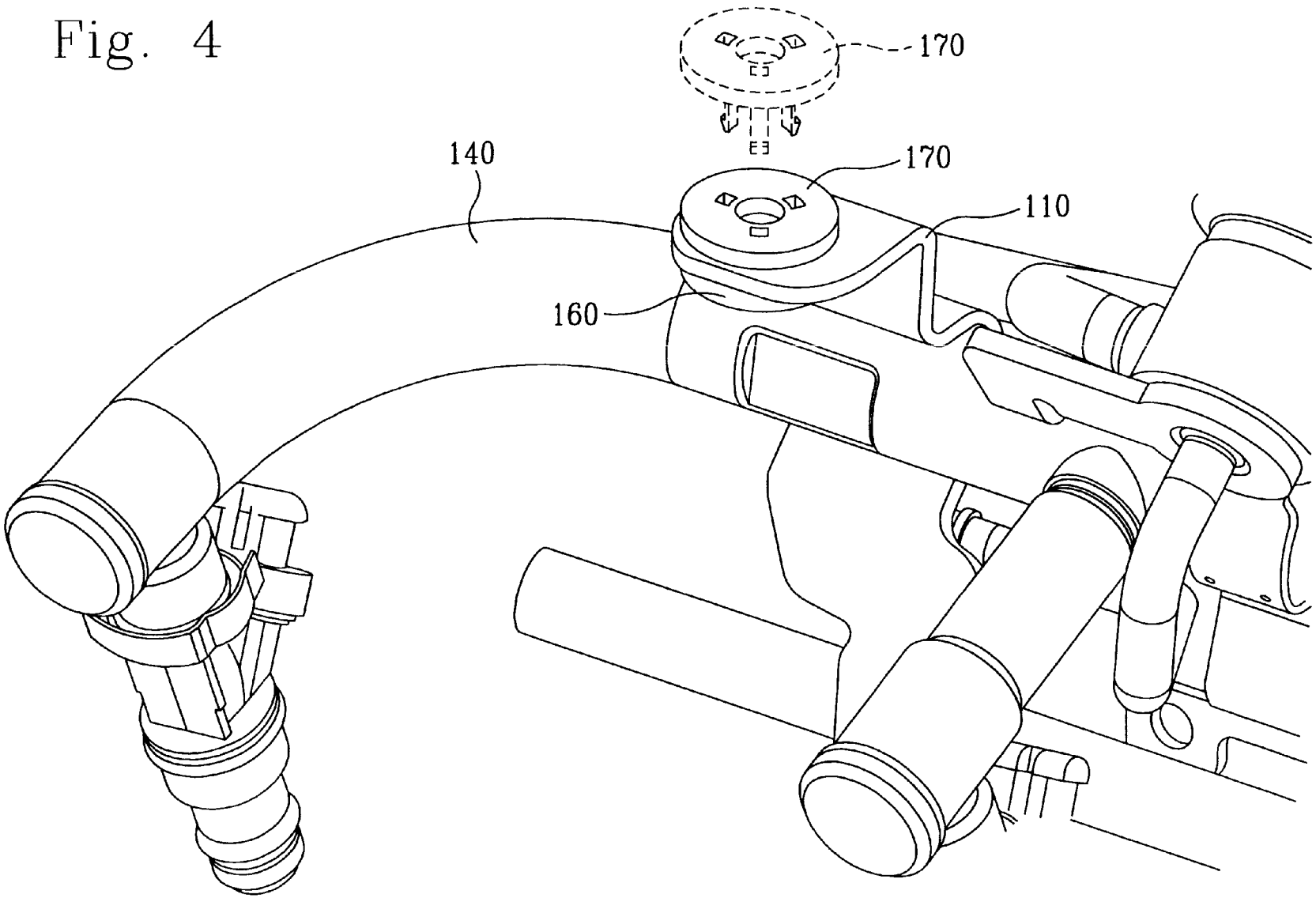
FIG. 4 is a second embodiment of the isolator assembly according to this invention.

The plastic isolator design 100 of this invention provides for the isolation of each fuel rail mounting bracket 110 in FIGS. 3 and 4 from the intake manifold mounting boss 120 and the screw assembly 130 that secures the fuel rail assembly 140 to the intake manifold 150. This isolation reduces the amount of heat transfer from the hot engine intake manifold 150 to the fuel rail assembly 140, which in turn transfers heat back to the fuel tank via the fuel return line. In the preferred embodiment, isolation of the fuel rail assembly 140 to the intake manifold 150 is accomplished by a two piece nylon 6/6 33% glass filled isolator washer 160 placed between the fuel rail mounting bracket 110 and the manifold mounting boss 120. An isolator sleeve 170, of the same material, is placed between the bracket 110 and the screw assembly 130 load-distributing washer 180. The isolator sleeve 170 has three locking tabs 190, which snap onto an inside diameter rib 161 on the isolator washer 160. The screw assembly 130 passes through each of the isolator sleeve 170 and isolator washer and between each locking tab 190 to thereby securely lock each element of the isolator design 100 onto the bracket 110.

The assembly described above and shown in FIG. 3 provides a means of attachment for both isolator parts 160, 170 to the fuel rail mounting bracket 110. This assembly secures the isolator to the bracket 110 of the rail assembly 140 during handling until installation of the rail on the manifold 150 is completed (see FIGS. 3 and 4). The locking tabs 190 also provide isolation of the screw assembly 130 with respect to the mounting bracket 110.

FIG. 4 shows a partial view of an alternate layout of the fuel rail 140 and shows the mounting bracket prior to assembly on the manifold where only the bracket 110, isolator washer 160 and isolator sleeve 170 are shown.

Figure 5:
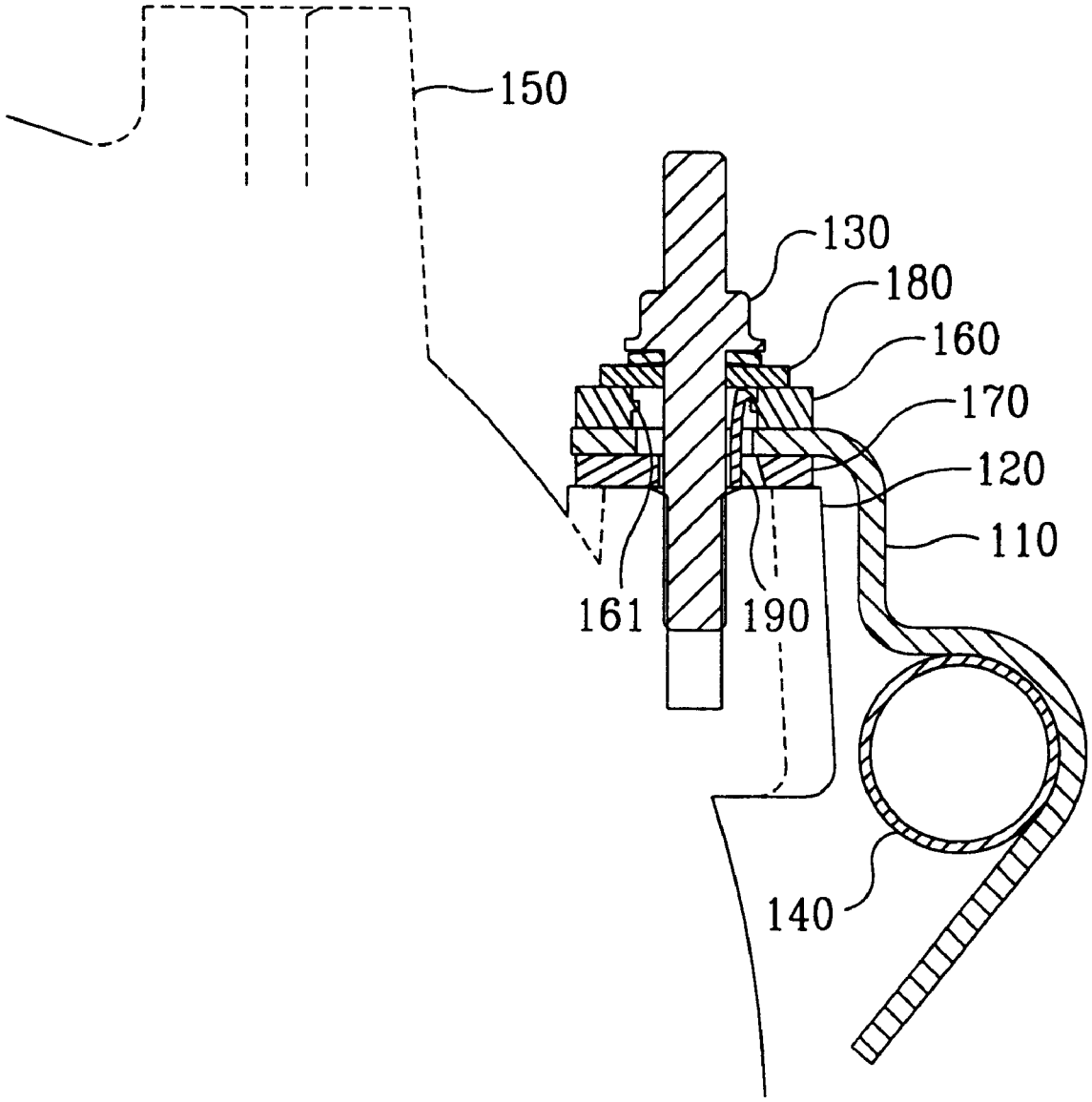
FIG. 5 is an alternate arrangement of the isolator design.

FIG. 5 shows an alternate arrangement of the isolator design wherein the placement of the isolator washer 160 and isolator sleeve 170 are reversed.

It should be noted that the isolator washer 160 may be made of a stiffer material, such as phenolic, if space is a constraint for the intake manifold 150 and manifold mounting boss 120 surface, as the nylon will require more area to properly distribute the torque load of the rail attaching screwing 130. Similar and equivalent materials for the isolator member 160, 170 will be apparent to those of skill in the art.

The competitive benefit of the plastic isolator design is that it provides a simple method to incorporate an isolator to a metal fabricated fuel rail design with a minimal snap-on fit attachment load. The user does not have to handle loose parts during the fuel rail to intake manifold assembly process. Also, if vehicle barrier issues are of a concern, which may negate the use of a plastic fuel rail, and a heat sink prone metal fabricated fuel rail is required, vehicle driveability problems resulting from hot fuel handling may be addressed by incorporating the plastic isolators.

The use of plastic isolators can allow for more flexibility in proposing fuel rail design processes that are more cost effective, that will meet stringent customer packaging and performance requirements, and be more conducive to efficient manufacturing capabilities. Barrier concerns can be addressed allowing the use of metal fabricated fuel rails in place of plastic fuel rails, where protection of the fuel system is reduced. Packaging issues can be addressed where the intake manifold requires an unconventional fuel rail design, which may dictate a metallic fuel rail process that does not permit a cost effective process such as plastic to be used, yet hot fuel handling may be a concern.

Press fitting an isolator onto a metal fuel rail design requires more tooling and maintenance issues to be addressed. A manual, light force snap-fit installed isolator can make the overall manufacturing process more efficient and effective.

The plastic snap-on rail mounting isolators of this invention reduce the heat transfer from a hot intake manifold to a metal fabricated rail. This heat transfer would potentially cause hot fuel handling problems as well as heat the excess unused fuel from the fuel rail being returned back to the fuel tank. In turn, this can cause vehicle emission problems. The snap-on feature prevents loose parts from falling into the manifold and eventually into the engine block, which may potentially damage the engine.

While the foregoing invention has been shown and described with reference to a preferred embodiment, it will be understood by those of skill in the art that various changes in form and detail may be made therein without departing from the spirit and scope of this invention. For example, the invention has been described with reference to a plastic isolator; however, the invention should not be limited to that material as those skilled in the art may have knowledge of other materials that possess the same properties and benefits associated with the plastic isolator described herein.

What is claimed is:

1. An isolator assembly for a fuel rail system, said isolator assembly comprising:

a fuel rail delivering fuel from a fuel source to at least fuel injector;

a bracket extending from said fuel rail;

a first washer disposed on a first side of said bracket;

an isolator sleeve disposed on a second side of said bracket opposite said first side, said isolator sleeve positively engaging said first washer.

2. The isolator assembly according to claim 1, further comprising a fastener passing through said isolator sleeve, said bracket and said first washer, said fastener adapted to positively engage an engine intake manifold.

3. The isolator assembly according to claim 2, further comprising a load-distributing washer disposed between said isolator sleeve and said fastener, said load-distributing washer distributing a load applied by said fastener.

4. The isolator assembly according to claim 1, wherein said isolator sleeve comprises a plurality of resilient attachment legs that snap-fit onto said first washer.

5. The isolator assembly according to claim 4, wherein said first washer comprises a. rib portion along an inner peripheral surface, said rib portion frictionally engaging said attachment legs.

6. The isolator assembly according to claim 1, wherein said fuel rail is formed of a heat-conducting metallic material.

7. The isolator assembly according to claim 1, wherein said first washer is a two-piece nylon washer.

8. The isolator assembly according to claim 7, wherein said two-piece nylon washer is glass-filled.

9. The isolator assembly according to claim 1, wherein said isolator sleeve is a two-piece nylon washer.

10. The isolator assembly according to claim 9, wherein said two-piece nylon isolator sleeve is glass-filled.

11. A fuel delivery system for an engine comprising:

an engine including an intake manifold;

a fuel rail delivering fuel from a fuel source to at least fuel injector of said engine, said fuel rail being mounted on said engine at at least one manifold mounting boss;

a bracket extending from said fuel rail;

a first washer disposed on a first side of said bracket;

an isolator sleeve disposed on a second side of said bracket opposite said first side, said isolator sleeve positively engaging said first washer; and a fastener passing through said isolator sleeve, said bracket and said first washer, said fastener positively engaging said at least one manifold mounting boss.

12. The isolator assembly according to claim 11, further comprising a load-distributing washer disposed between said isolator sleeve and said fastener, said load-distributing washer distributing a load applied by said fastener.

13. The isolator assembly according to claim 11, wherein said isolator sleeve comprises a plurality of resilient attachment legs that snap-fit onto said first washer.

14. The isolator assembly according to claim 13, wherein said first washer comprises a rib portion along an inner peripheral surface, said rib portion frictionally engaging said attachment legs.

15. The isolator assembly according to claim 11, wherein said fuel rail is formed of a heat-conducting metallic material.

16. The isolator assembly according to claim 11, wherein said first washer is a two-piece nylon washer.

17. The isolator assembly according to claim 16, wherein said two-piece nylon washer is glass-filled.

18. The isolator assembly according to claim 11, wherein said isolator sleeve is a two-piece nylon washer.

19. The isolator assembly according to claim 18, wherein said two-piece nylon isolator sleeve is glass-filled.

20. The isolator assembly according to claim 11, wherein said first washer is a phenolic washer.

* * * * *